US005697249A

United States Patent [19]

Miguchi

[11] Patent Number: 5,697,249

[45] Date of Patent: Dec. 16, 1997

[54] PORTABLE DRIVE UNIT

[75] Inventor: Akio Miguchi, Irvine, Calif.

[73] Assignee: Kawasaki Jukogyo Kabushiki Kaisha, Kobe, Japan

[21] Appl. No.: 516,413

[22] Filed: Aug. 17, 1995

[30] Foreign Application Priority Data

| | | | |
|---|---|---|---|
| Sep. 9, 1994 | [JP] | Japan | 6-215758 |
| Sep. 9, 1994 | [JP] | Japan | 6-215761 |
| Sep. 9, 1994 | [JP] | Japan | 6-215763 |

[51] Int. Cl.[6] ..... F01B 23/00

[52] U.S. Cl. ..... 74/16; 192/115

[58] Field of Search ..... 74/16; 192/115; 248/637, 647, 648

[56] References Cited

U.S. PATENT DOCUMENTS

| | | | |
|---|---|---|---|
| 2,097,729 | 11/1937 | Mall | 74/16 X |
| 2,361,768 | 10/1944 | Heintz et al. | 74/16 |
| 2,446,645 | 8/1948 | Flinchbaugh | 74/16 |
| 2,522,960 | 9/1950 | Price | 74/16 |
| 2,538,276 | 1/1951 | Shoffner | 74/16 X |
| 2,614,433 | 10/1952 | Cuckler | 74/16 |
| 4,280,373 | 7/1981 | Denkowski et al. | 74/625 |
| 4,655,335 | 4/1987 | Maruyamano et al. | 192/115 X |

FOREIGN PATENT DOCUMENTS

| | | | |
|---|---|---|---|
| 0278931 | 8/1988 | European Pat. Off. | 248/637 |

*Primary Examiner*—Rodney N. Bonck

*Attorney, Agent, or Firm*—Armstrong, Westerman, Hattori, McLeland & Naughton

[57] ABSTRACT

An engine 2, a reduction gear 3, and a clutch 4 detachably coupling a reducing input shaft 25 of the reduction gear 3 to an engine output shaft 24, are housed in and supported to a support and frame work 1. A reducing output shaft 26 of the reduction gear 3 is used for a power takeoff shaft of the drive unit, and an input shaft of a work machine is coupled the power takeoff shaft, so that the work machine is operated. A weight of the support and frame work 1 is made smaller than a total weight of the engine 2, the reduction gear 3 and the clutch 4 so as to decrease a weight of unit. Thus, an over-loading can be overcome easily by using a friction clutch for the clutch 4.

6 Claims, 17 Drawing Sheets

PORTABLE DRIVE UNIT

BACKGROUND OF THE INVENTION 1. (Technical field)

This invention relates to a portable drive unit.

2. Prior Art

A tractor having a power takeoff shaft (PTO shaft) has generally been utilized as a drive unit for driving an agricultural work machine or a small lawn maintenance machine, or the like.

Such prior art was laid open to public inspection on Apr. 4, 1991 under Japanese Provisional Publication No. 79432/91.

In contrast to a tractor having a running gear (travel gear), there are portable drive units equipped with no running gear, such as a unit on which only an engine is mounted, a unit on which an engine with manual clutch is mounted, and a generating unit or pump unit on which a generator or a pump, together with the engine, are mounted.

(Problems to resolve)

(1) In the former tractor, other functions such as travel performance and habitability, etc. are important and this is very expensive. Further, the travel speed of the tractor itself is very low so that it takes a long time to transport the tractor to a remote place.

addition, the entire tractor is massive and heavy so that the tractor is inconvenient even when it is transported by being mounted on a vehicle, such as a truck having comparatively high travel speed.

In the latter portable drive unit, differing from the tractor outputting its power from the power takeoff shaft by reducing an engine revolution speed to a specified speed, it is difficult to couple the unit directly to various driven units which are driven by shaft outputs at specified revolution speeds.

An agricultural work machine, such as a lawn mower, a sprayer or a screw conveyer for taking-in silo (harvesting grain elevator), is designed to be driven by a shaft output at 540 RPM, which is a rated revolution of the power takeoff shaft of the tractor, and these machines cannot be driven by using the above-mentioned conventional portable drive unit as it is.

(2) In the former tractor, a torque reaction can be counteracted sufficiently by the weight of the tractor itself, even when a large torque is output, so that oscillation of the tractor can be controlled. However, as above mentioned, the tractor itself gives much importance to other functions, such as travel performance and habitability, etc. and this is very expensive when used only for the purpose of a drive unit. Further, travel speed of the tractor itself is very low so that it takes a long time to transport the tractor to a remote place. In addition, the entire tractor is massive and heavy so that the tractor is inconvenient even when it is transported by being mounted on a vehicle, such as a truck, having comparatively high travel speed.

A generating unit ordinarily has a framework of pipe frame structure and its entire weight is carried by the framework, but an overall width of the framework is only a little larger than that of internal components, such as an engine and a generator, etc. Accordingly, when a portable drive unit equipped with a reduction gear is constructed only by such a pipe frame structure, only a little torque can be output in order to avoid the oscillation of the drive unit caused by the torque reaction so that the field of application is narrowed.

(3) In the former tractor, a position, especially the height of the power takeoff shaft, is fixed so that a variation of input shaft position of the driven unit is accommodated only by such a countermeasure that universal joints are installed on both sides to cope with angular changes of axle shafts transmitting power from the power takeoff shaft to the driven unit.

Therefore, there are such problems that an angle of the axle shaft becomes excessively large depending on the height of the drive unit input shaft to cause a decrease in transmission efficiency, and the length of the axle shaft must be enlarged in order to decrease the angle of axle shaft so that its weight increases.

SUMMARY OF THE INVENTION (Objects of the invention)

(1) An object of the invention is to provide a portable drive unit which directly drives a driven unit, such as an agricultural machine etc., having been driven previously by a power takeoff shaft of a tractor, which drive unit is small, can be moved easily, and provides wide general purpose.

(2) Another object of the invention is to provide a portable drive unit which directly drives a driven unit, such as an agricultural machine etc., having been driven previously by a power takeoff shaft of a tractor, and which can be moved easily, and can control oscillation caused by a torque reaction while securing a large torque output.

(3) Further other objects of the invention are to increase its allowable transmission torque, and the service life of a universal joint for an axle shaft, and to reduce the weight and cost of the axle shaft.

(Structure of the invention)

According to a first aspect of the invention, there is provided a portable drive unit, in which an engine, a reduction gear and a clutch which couples a reducing input shaft of the reduction gear to an engine output shaft in a detachable manner, are housed in, and supported by, a support and framework, and a reducing output shaft of the reduction gear is utilized as a power takeoff shaft of the drive unit.

In the drive unit of the invention, the portable drive unit is one in which a weight of the support and framework is made smaller than the total weight of the internal components, such as the engine, the reduction gear and the clutch etc.

In the drive unit of the invention, the portable drive unit incorporates a single-plate friction clutch serving as the clutch.

In the drive unit of the invention, the portable drive unit employs a centrifugal friction clutch serving as the clutch.

According to another aspect of the invention, there is provided a portable drive unit, in which an engine and a reduction gear utilizing the engine as its power supply, are housed in a support and framework and supported by the framework, a reducing output shaft of the reduction gear is utilized as a power takeoff shaft of the drive unit, and a fixing means, which extends in a horizontal direction at approximately a right angle to the power takeoff shaft and has a length longer than a width of the support and framework, is installed at a bottom portion of the framework.

In the drive unit according to this aspect of the invention, a portable drive unit is provided, in which straight pipe members are fixed at power takeoff shaft side bottom portions of both ends of the framework to serve as the fixing means.

In the drive unit according to this aspect of the invention, a portable drive unit is provided, in which the overall length of the fixing means is made expandable.

In the drive unit of the invention there is provided a portable drive unit, in which the length of the fixing means is determined such that the distance from the center of gravity of the unit to the remotest contact with ground at its one side extending opposite to the direction of revolution of the power takeoff shaft, is set larger than a value obtained by dividing a maximum torque of the power takeoff shaft with a total weight of the unit.

In the drive unit of the invention there is further provided a portable drive unit in which a fuel tank is installed at a place opposite to the direction of the revolution of the power takeoff shaft relative to the center of gravity of the entire unit.

According to yet another aspect of the invention, there is provided a portable drive unit in which an engine and a reduction gear utilizing the engine as its power supply are housed in, and supported by, a support and framework, the reduction gear is so constructed that its reducing output shaft forming a power takeoff shaft is installed eccentrically relative to a reducing input shaft and the reduction gear is fastened to a bracket of the framework with its rotational position changeable around the axis of the reducing input shaft, and the height of the reducing output shaft is freely changeable by changing the rotational position of the reduction gear.

In the drive unit according to this aspect of the invention, a portable drive unit is provided in which a clutch coaxial with the engine output shaft is installed between the engine and the reduction gear, and a cylindrical positioning guide cover, which covers an outer periphery of the clutch and connects concentrically the reducing input shaft side of the reduction gear with the output shaft side of the engine, is installed between them.

(Operation)

The power takeoff shaft of the drive unit is directly coupled to an input shaft of a driven unit of an agricultural work machine, or the like, by a coupling shaft having a universal joint.

The engine is started under a clutch disengaged state, and the clutch is engaged at a specified engine revolution to operate the driven unit.

The input shaft of the driven unit is driven at a specified revolution speed reduced by the reduction gear, for example at 540 RPM.

The weight of the support and framework is made smaller than the total weight of the internal components, such as the engine, the reduction gear and the clutch, etc. in the concerned drive unit so that the framework can be easily carried by hand, not only when transporting the unit by machine to a remote place, but also when moving it manually to a neighboring place.

A single-plate friction clutch is equipped for serving as the clutch, so that an over-loading can be avoided by slippage of a partially engaged clutch without stopping the engine when coupling the unit to a machine, such as a grain elevator or a hole digger (auger-type digger), which is subjected to a temporary overloading torque because it deals with powdery or solid articles.

In other words, when a large load is applied to the power takeoff shaft from the work machine side, the single-plate friction clutch can be controlled to slip to bring about a partially engaged state so that a high torque is thereby maintained at a low revolution and the over-loading condition is avoided.

Alternatively, a centrifugal friction clutch can be provided so that the clutch is automatically disengaged at the time of starting the engine and the clutch is engaged by a centrifugal force when the engine revolutions increase to a specified value.

In the event of an over-load applied by the work machine, the over-loading state can be avoided by the slippage of clutch in the same way as the single-plate friction clutch.

In the portable drive units of the invention in order to carry the unit manually to a neighboring place, both the front and rear portions of the fixing means are provided with grips to be grasped by hand.

When transporting or operating the unit while it is mounted on a vehicle, the expandable fixing means are expanded and thrust against right and left walls of the rear body and fixed to them. Thus, oscillation in the horizontal direction is prevented.

When the unit is used in a place in which it cannot be fixed to a floor or the ground, it is enough to only place the unit on the floor. In this case, the length of the fixing means is so determined that the distance from the center of gravity of the unit to its remotest contact with the ground at its one side extending opposite to the revolution direction side of the power takeoff shaft, is set larger than the value obtained by dividing the maximum torque of the power takeoff shaft with the total weight of the unit. For this reason, a moment produced by the weight of the unit with respect to the contact point with the ground forms a reaction larger than the torque reaction so that vertical oscillation due to the torque reaction is controlled.

In the case in which the unit is operated for a long time continuously, the fuel tank is installed at the place opposite to the power takeoff shaft revolution direction side with respect to the center of gravity of the unit, so that a decrease in the moment produced from the contact point of the unit with the ground due to the weight of fuel can be controlled to a minimum even when the fuel runs short after a long period of time.

In the case, for example, when the operation is commenced with the fuel tank full and unmanned continuous operation is carried out thereafter, as the fuel decreases, the moment owing to the fuel weight against the torque reaction decreases with the decrease in its weight. However, since the fuel tank is installed at a place closer to the momentum fulcrum point than the center of gravity of unit, the distance from the fulcrum point is shortened and the change in the momentum force of fuel weight due to the increase or decrease in fuel weight is small. Consequently, since the momentum force for controlling the torque reaction does not change significantly between immediately after the commencement of operation of the unit and after an elapse of considerable time of continuous operation thereof, oscillation of the unit after the continuous operation does not occur.

In portable drive units according to the invention, when the drive unit is placed on a ground surface and the height of the input shaft of the driven unit is higher than that of the drive unit, the position of the reducing output shaft, i.e. the power takeoff shaft, can be set high by changing the rotational position of the reduction gear around the reducing input shaft.

On the other hand, when the drive unit is mounted on a rear body of a vehicle, or the like, to drive a driven unit connected to the rear of the rear body, the rotational position of the drive unit is changed to lower the position of the power takeoff shaft because the height of the input shaft of the driven unit becomes lower than that of the driven unit.

(Effects of the invention)

(1) According to an aspect of the invention:

(1-1) Agricultural work machines, and small lawn maintenance machines, which have previously been driven only by the power takeoff shafts of vehicles, such as tractors, or turf utility vehicles, or the like, can be driven directly by the portable drive unit, which is smaller in weight and cheaper in price than these vehicles, so that vehicle price and maintenance cost can be reduced.

(1-2) Since the engine, the reduction gear and the clutch are housed in and supported by the support and framework, a reduction in size and weight can be accomplished more easily than with the tractor so that manual carrying becomes possible and the transportation by a high speed vehicle to a remote place becomes easy so as to meet demands at remote places quickly.

(1-3) Not only by mounting the unit on a high speed vehicle and transporting it, but by utilizing the vehicle in place of the tractor, a vehicle having a workability of the tractor in combination with a transporting ability of a truck can be constructed so that a range of application can be widened.

(1-4) The unit can be mounted directly on a work machine, such as a sprayer or a hole digger etc., having no power and can be used, not only for a general power supply, but for a single-purpose power supply, so that the work machine can be motorized easily.

(2) According to another aspect of the invention, in addition to the effects described in the foregoing articles (1-1) through (1-4), the unit can be moved by gripping the framework more easily not only when transporting it by a vehicle but when carrying it by hand.

(3) According to the invention, in addition to the effects described in the foregoing articles (1-1) through (1-4), a single-plate friction clutch slips to bring about a partially engaged state and a high torque is maintained at a low revolution so that over-loading can be avoided by the slippage of the partially engaged clutch without stopping the engine when coupling the unit to a machine, such as a grain elevator or a hole digger (auger-type digger), which are subjected to a temporary over-loading torque because they deal with powdery or solid articles.

(4) According to the invention, in addition to the effects described in the foregoing articles (1-1) through (1-4), the clutch operation is not required at the time of starting the engine, and the over-loading condition can be avoided by the slippage of the clutch in the same way as a single-plate friction clutch when the over-load is applied from the work machine.

(5) According to the invention, the fixing means installed at the bottom portion of the framework extends in the horizontal direction at approximately a right angle to the power takeoff shaft and is longer than the width of the support and framework, so that the momentum force created by the weight of unit itself can overcome the torque reaction sufficiently and can prevent vertical oscillation of the drive unit by only placing the unit on the ground or a floor, etc., even if it is difficult to fix the unit to these surfaces by bolts, or the like.

(6) According to the invention, the straight pipe members are fixed for serving as the fixing means so that an increase in weight of the unit can be controlled, and the fixing means itself can be utilized as the grips to enable carrying of the unit so that the carrying work by hand becomes easy.

(7) According to the invention, the overall length of the fixing means is made expandable, so that the drive unit can be fixed by expanding and thrusting the fixing means against the walls of a rear bed in cases in which the unit is mounted on a vehicle that performs the transportation or the work. Thereby, the portable drive unit is not shaken in the horizontal direction even if a load is applied in the horizontal direction. In other works, it is not required to install various fixing or positioning means, such as fixing clamps or clamp fitting holes, or the like, on the vehicle rear body, so that the unit is inexpensive and the vehicle itself is hard to be damaged.

Further, since fixing of the unit to the floor, or the like, and fixing of it to the vehicle, or the like, can be done by the identical fixing means, the unit is economical.

(8) According to the invention, the length of the fixing means is so determined that the distance from the center of gravity of the unit to the remotest contact with ground at its one side extending opposite to the revolution direction side of the power takeoff shaft, is set larger than the value obtained by dividing the maximum torque of the power takeoff shaft with the total weight of the unit, so that the torque reaction can always be overcome by the momentum force larger than the torque reaction and vertical oscillation of the drive unit due to the torque reaction can be prevented. Thus, the function to control oscillation due to the torque reaction is improved further.

(9) According to the invention, the engine, and the reduction gear utilizing the engine as its power supply, are housed in the support and framework and supported outside of the framework, the reducing output shaft of the reduction gear is utilized as the power takeoff shaft of the drive unit, and the fuel tank is installed at a place opposite to the revolution direction side of the power takeoff shaft relative to the center of gravity of the entire unit, so that the torque reaction an be overcome by the momentum force changing a little without being affected significantly by an increase or decrease of fuel.

Therefore, even when the fuel decreases due to a long elapse of time after commencing the operation in case of an unmanned continuous operation, the torque reaction control force is not decreased by it considerably so that oscillation produced by the torque reaction can be prevented under a state of not changing significantly from the commencement of operation.

(10) According to the invention (10-1) Since the height of the power takeoff shaft can be set in conformity with input shaft heights of various driven units by changing the rotational position of the reduction gear, a tilting angle of the axle shaft can be controlled to a minimum, and the relative distance between the power takeoff shaft and the input shaft of the driven unit can be shortened, so that the allowable transmission torque and the service life of a universal joint installed in the joint axle shaft can be increased.

(10-2) Since the height of the power takeoff shaft can be set in conformity with input shaft heights of various driven units, by changing the rotational position of the reduction gear the relative distance between the power takeoff shaft and the input shaft of driven unit can be shortened, so that the axle shaft can be shortened to enable a reduction in the weight and cost of the axle shaft.

(10-3) The height of the power takeoff shaft can be set voluntarily. Therefore, when the unit is operated on the rear body of vehicle, it becomes possible to mount and operate the unit on various vehicles easily by setting the position of the power takeoff shaft according to situations such as opening/closing of the rear gate of the vehicle body and the height of the rear gate, etc.

(11) According to the invention, the following effects can be obtained in addition to the foregoing effects (10-1) through (10-3).

The clutch, coaxial with the engine output shaft, is installed between the engine and the reduction gear, and the cylindrical positioning guide cover which covers the outer periphery of the clutch and connects concentrically, the output shaft side of the engine with the reducing input shaft side of the reduction gear, is installed between them, so that an accuracy of concentricity between the engine output shaft and the reducing input shaft can be maintained at a high value even when the reduction gear is installed with its rotational position changeable.

BRIEF DESCRIPTION OF DRAWINGS

FIG. 10 is a rear view showing a state of the fixing mean when installing the drive unit of the invention, on a floor, or the like;

DETAILED DESCRIPTION OF THE INVENTION (Embodiment)

Figure 2:
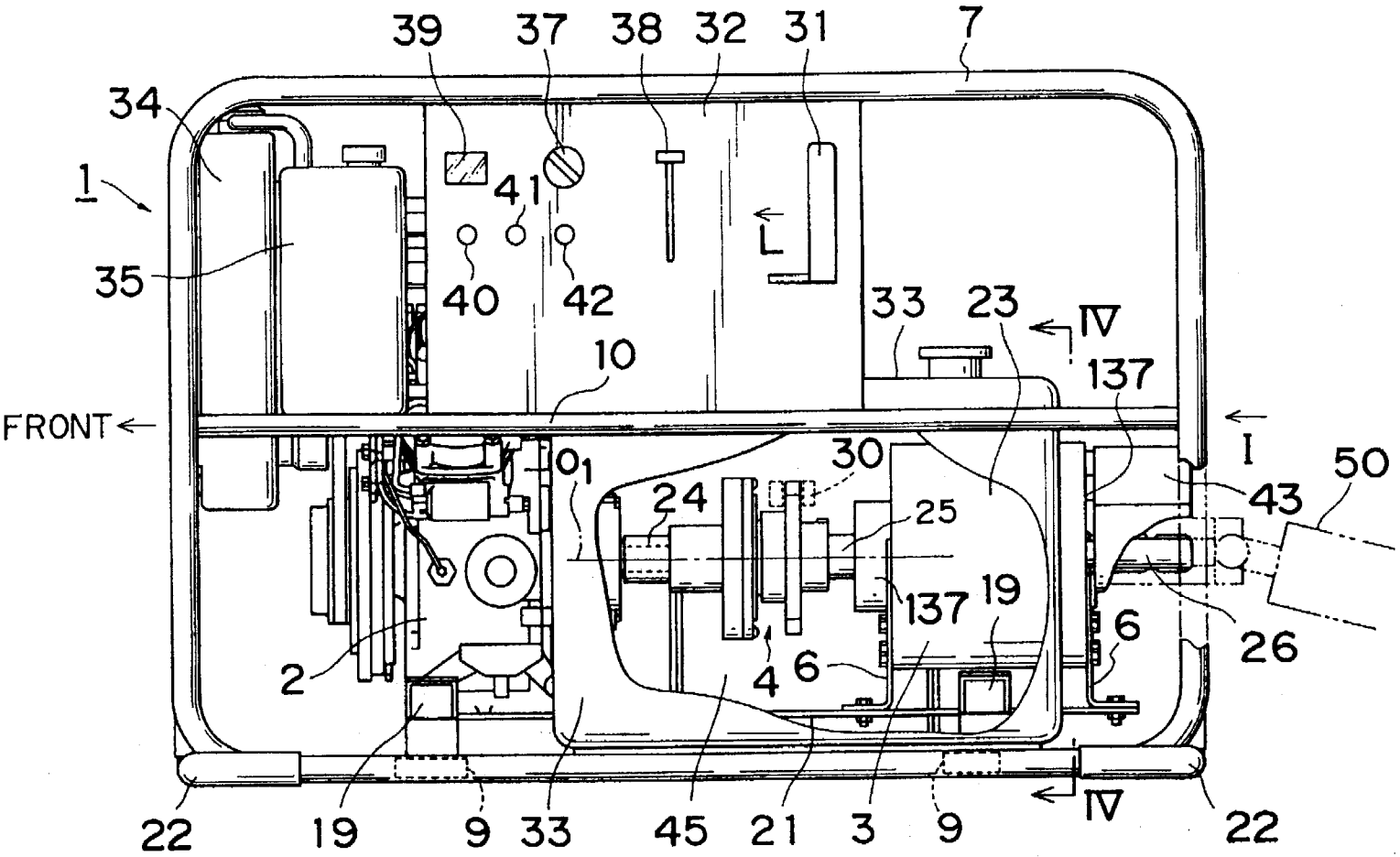
FIG. 2 is a view taken in the direction of the arrow II in FIG. 1.
Figure 3:
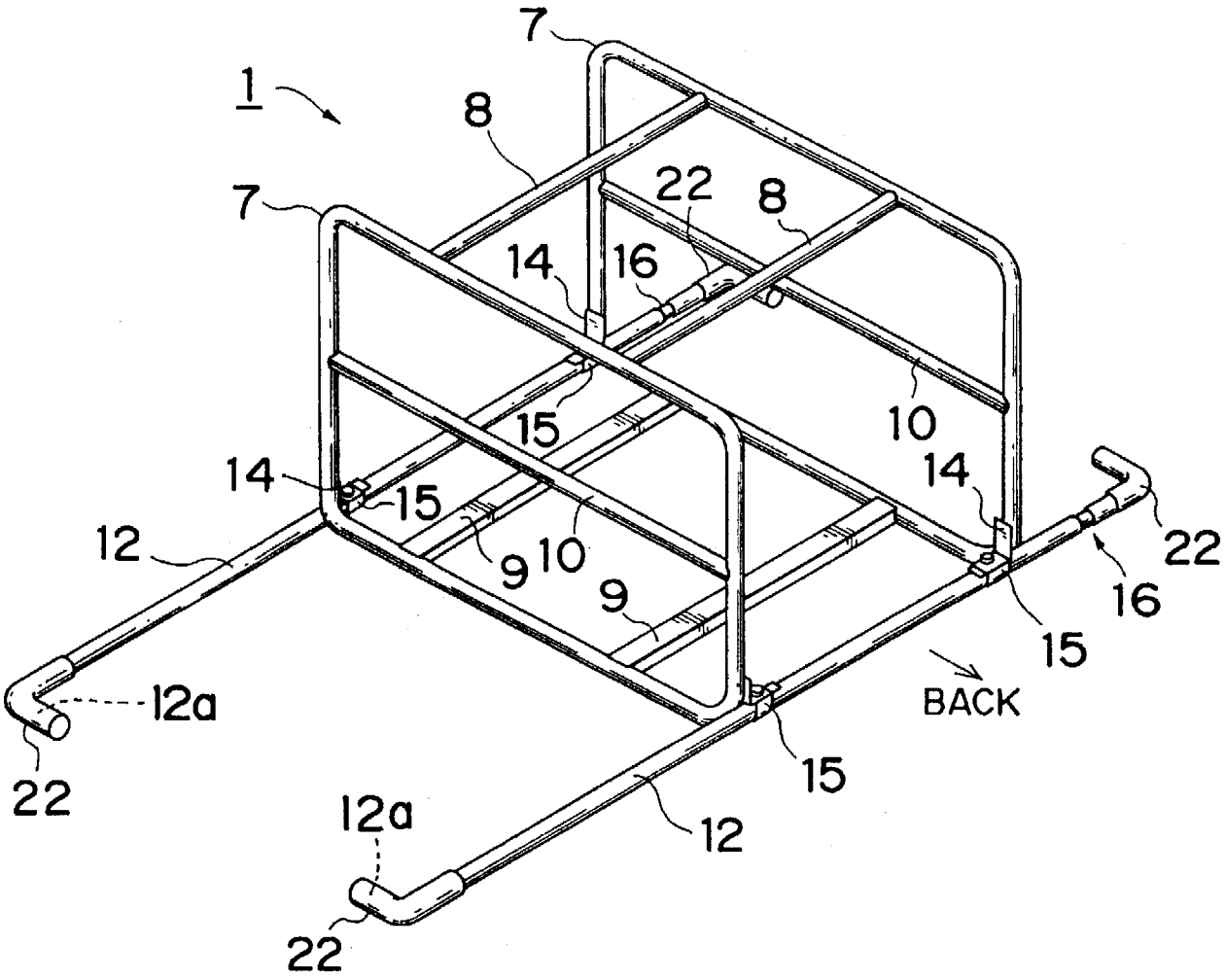
FIG. 3 is an oblique view of a support and framework.

FIG. 1 through FIG. 5 and FIG. 7 through FIG. 19 show the portable drive unit to which the invention is applied. FIG. 3 shows an oblique view of a support and framework 1. The support and framework 1 is composed of a pair of left and right rectangular upright side pipes 7, two upper cross pipes 8 which rigidly connect upper ends of the both side pipes 7, two engine supporting cross members 9 which rigidly connect lower ends of the both side pipes 7, and reinforcing pipes 10 secured to and between front and rear pipe portions of the respective side pipes 7. The respective pipes 7, 8, 10 and cross members 9 are made of metal, such as stainless steel or aluminum, etc.

A round pipe is used for the side pipe 7, the upper cross pipe 8 and the reinforcing pipe 10, and a member with a flat upper surface, for example, a channel member having a rectangular cross section or downward U-shaped cross section, is used for the engine supporting cross member 9. The cross pipe 8 and the cross member 9 extend in a lateral direction intersecting at right angle to the side pipe 7, and the reinforcing pipe 10 extends in a longitudinal direction.

Joints of respective pipes are joined by welding, for example, and the entire framework 1 is formed into an approximately rectangular prism.

A pair of fixing pipes 12 extending horizontally in the lateral direction are secured to front and rear lower ends of the support and framework 1 for serving as a fixing means. The fixing pipe 12 is fastened by U-shaped metal clamps 15 to L-shaped brackets 14 welded to front and rear ends of the side pipes 7. An overall length of the fixing pipe 12 is made longer than a lateral width of the framework 1 and protrudes toward outside from the both left and right sides of the framework 1. Tip ends of the fixing pipe 12 are bent into L-shapes, and covers 22 made of resin are fitted onto the bent portions.

The respective fixing pipes 12 include expansion joints 16 at their right protruding portions so that their overall lengths can be adjusted freely by adjusting the joints 16. The tip end bent portions 12*a* can be set not only in a horizontal position but in selected positions, such as upward or downward positions, by loosening the clamps 15 and can be kept at this position.

Figure 7:
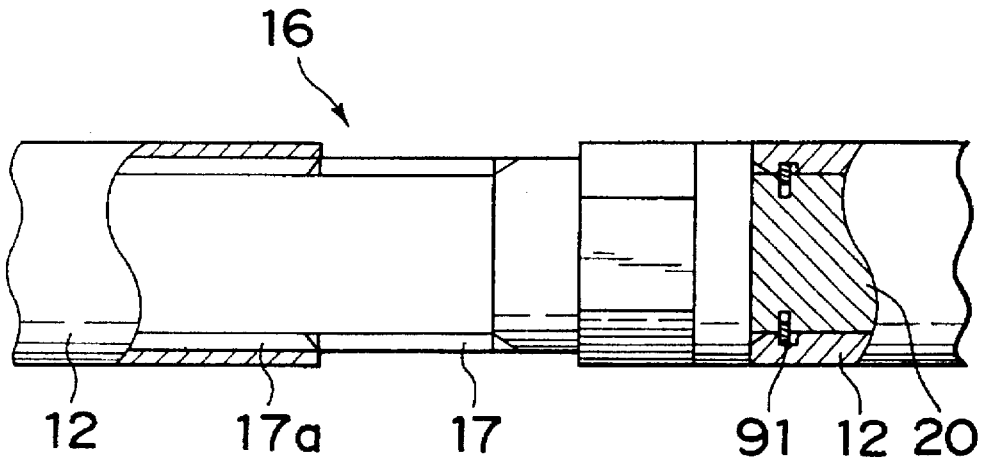
FIG. 7 is an enlarged vertical sectional view of an expansion joint of a fixing means according to the invention.
Figure 8:
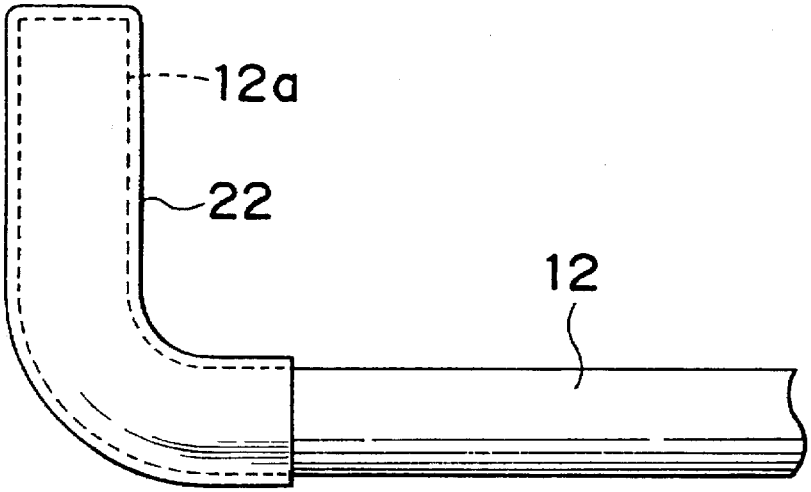
FIG. 8 is an enlarged plane view of the tip end of the fixing means.
Figure 9:
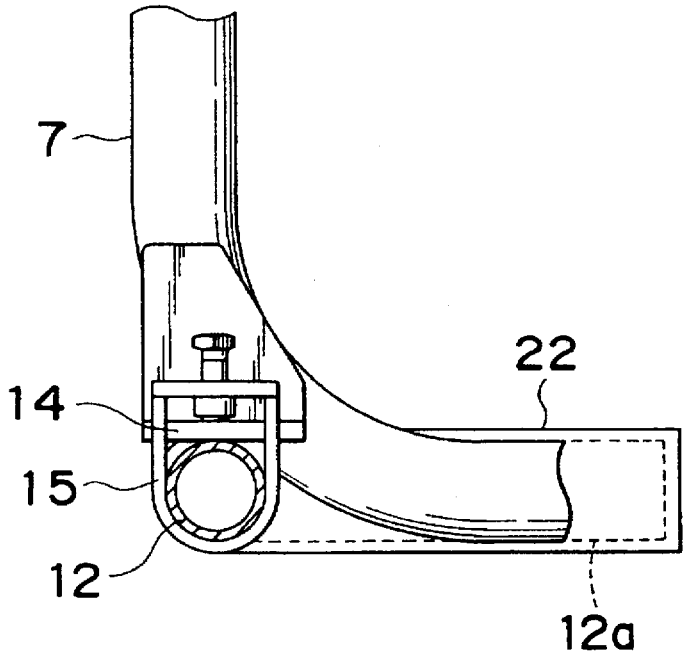
FIG. 9 is an enlarged sectional view taken along line IX—IX of FIG. 1.

FIG. 7 shows an enlarged sectional view of the expansion joint 16. A female screw thread 17*a* is formed on an inner peripheral surface of one of the fixing pipes 12 divided into two right and left parts; for example, a left-side fixing pipe 12 portion at the unit mounting side, and a rotation shaft 20 rotatable fitted in an inner peripheral surface of a right-side fixing pipe 12 portion. The rotation shaft 20 is fastened by a stop ring (snap ring) 91 so as not to move in the axial direction, and an adjusting bolt 17 is welded to the shaft integrally and coaxial with it.

Figure 1:
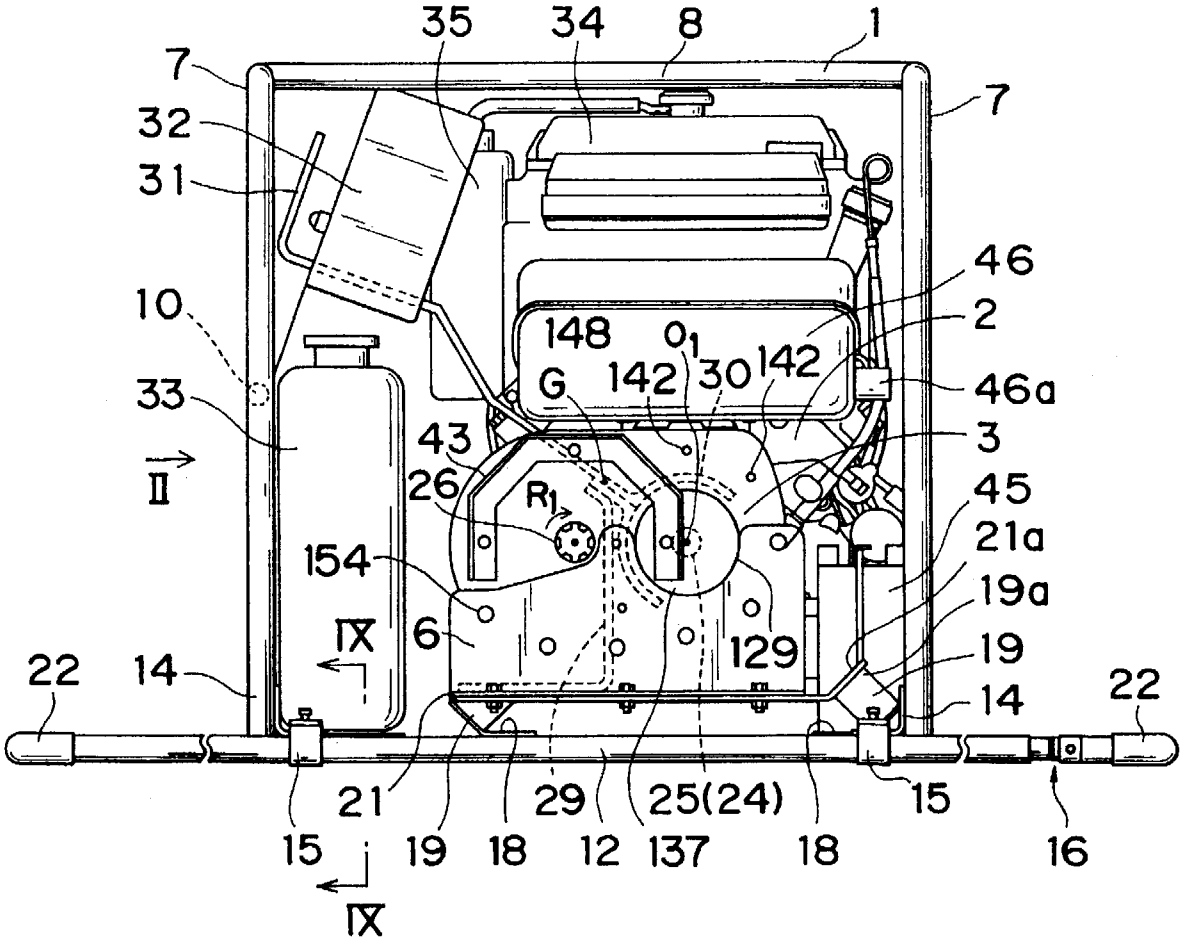
FIG. 1 is a rear view of the portable drive unit according to the invention.

In other words the entire length of the fixing means can be adjusted by rotating the adjusting bolt 17 relative to the both left and right fixing pipes 12 portions. An engine 2, a reduction gear 3, a clutch 4 and others composing the drive unit are all housed in and supported within a space surrounded by the support and framework as shown in FIG. 1 and FIG. 2. The weight of the support and framework 1 is made smaller than the total weight of the engine 2, the reduction gear 3, the clutch 4 and other components composing the drive unit.

In FIG. 2 showing the left side view (viewed in the direction of arrow II of FIG. 1), the engine 2, the reduction gear 3 and the clutch 4 are secured onto one bottom plate 21 to be formed into an integrated assembly, and the bottom plate 21 is supported at its four corners by the cross members 9 etc. of the framework 1 through dampers 19 made of rubber or resin etc.

The engine 2 is fixed to front parts of the bottom plate 21, and the reduction gear 3 is fixed to rear parts of the bottom plate 21 through support brackets 6. A V-type two cylinder horizontal shaft four-cycle engine is mounted for serving as the engine 2, and an engine output shaft 24 protrudes horizontally toward a rear side. The reduction gear 3 includes a reducing input shaft 25 protruding horizontally toward front side and a reducing output shaft protruding horizontally toward rear side, i.e. a power takeoff shaft 26. The reducing input shaft 25 is installed in coaxial relation with the engine output shaft 24, and the both shafts 24 and 25 are so coupled by the clutch 4 that these shafts can be engaged and disengaged freely. A rear edge of the power takeoff shaft 26 lies within a rear end face of the framework 1.

Figure 4:
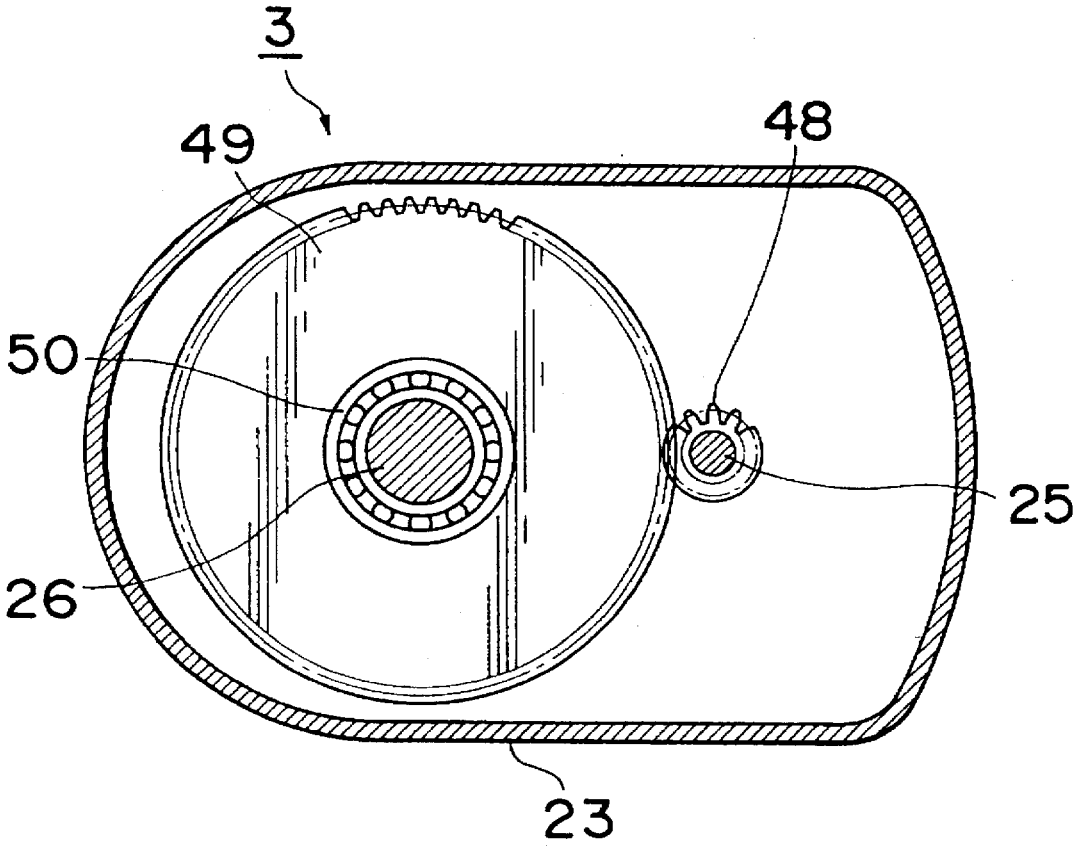
FIG. 4 is a sectional view of a speed change gear taken along line IV—IV of FIG. 2.

FIG. 4 is a sectional view of the reduction gear 3, a small spur gear 48 secured to the reducing input shaft 25 and a large spur gear 49 meshing with the small spur gear and secured to the power takeoff shaft 26 are installed in a reduction gear case 23, and the both gears 48 and 49 compose a reducing mechanism of fixed reduction ratio type. The reduction ratio is so set that a specified service revolution of engine (3200 RPM, for example) is reduced to 540 RPM to rotate the power takeoff shaft 26. Plural splines are cut on an outer peripheral surface of the power takeoff shaft 26 in the axial direction in the same way as that of the ordinary power takeoff shaft of a tractor, and the shaft is coupled to an input shaft of a work machine so that a universal joint of coupling shaft etc. is spline coupled thereto.

Figure 5:
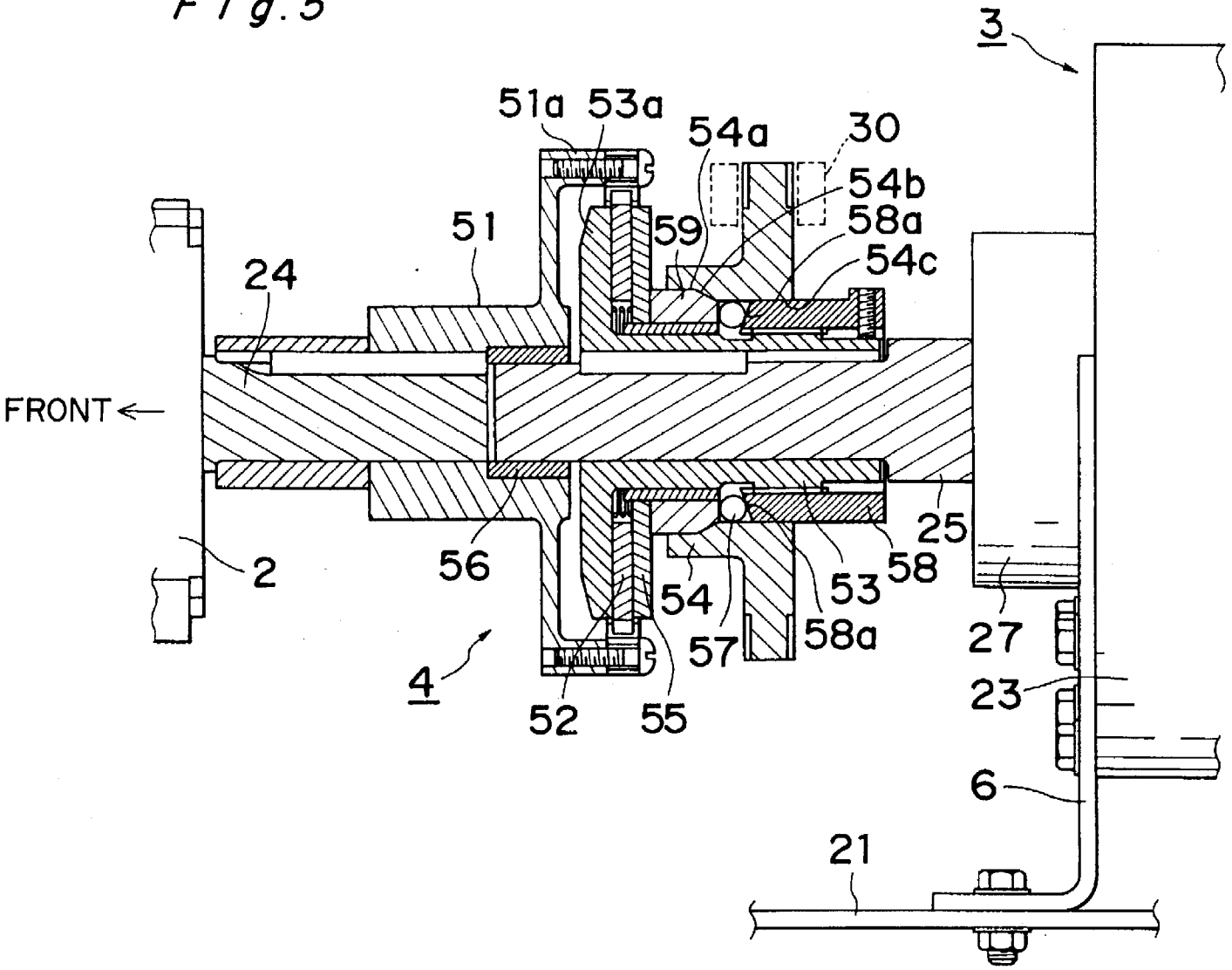
FIG. 5 is a vertical sectional side view of a single-plate friction clutch.

FIG. 5 shows the vertical sectional view of the clutch 4 which is a manual type single-plate friction clutch. A coupling hub 51 is secured to the engine output shaft 24, the coupling hub 51 integrally has a cylindrical clutch cover 51*a*, and a friction disc 52 spline fits in an inner peripheral side of the clutch cover 51*a* so that it can rotate integrally with the cover 51*a* and can move in the axial direction. The reducing input shaft 25 fits in, and is coaxial with, an inner peripheral surface of the coupling hub 51 at its tip end through a bush 56, a driven hub 53 spline fits onto an outer periphery of the reducing input shaft 25, and the driven hub 53 integrally has a disc-type clutch plate 53*a*. A fixed boss 58 is secured to a rear part of outer periphery of the driven hub 53, a pressing clutch sleeve 59 and a pressure plate 55 fit onto a front part of it so to move freely in the axial direction, and the friction disc 52 is installed between the pressure plate 55 and the clutch plate 53*a* so that it can be sandwiched by the two.

Plural cam balls 57 movable in radial directions are installed between the fixed boss 58 and the clutch sleeve 59, and a front edge of the fixed boss 58 in contact with the balls 57 is formed into a tapered cam surface inclined to rear side as it gets to radial outside. A slip ring 54 movable in the axial direction fits onto outer peripheral surfaces of the fixed boss 58 and the clutch sleeve 59. A large releasing portion 54*a* which fits onto the outer periphery of the clutch sleeve 59, and a small locking portion 54*c* which connects through a pressing tapered surface 54*b* to the large releasing portion 54*a* and fits onto the fixed boss 58, are formed on an inner peripheral surface of the slip ring 54. Consequently, when the slip ring 54 is moved forward, the balls 57 are pressed in the axial direction by the tapered cam surface 54*b* of the slip ring 54, the balls 57 are moved forward along the tapered cam surface 58*a* of the fixed boss 58, and the pressure plate 55 is pushed forward through the clutch sleeve 59. Thereby, the friction disc 52 is sandwiched between the pressure plate 55 and the clutch plate 53*a* to bring about an engaged state of the clutch 4.

A shift fork 30 engages with a flange portion of the slip ring 54, and the shift fork 30 is supported by a support bracket 29 so as to be swingable forward and backward and connected integrally to the clutch sleeve 31 as shown by FIG. 1. By turning the clutch lever 31 forward, the slip ring 54 is moved backward to release the clutch 4.

Incidentally, a return spring (release spring) may be fitted to the clutch lever 31, the shift fork 30 or the clutch sleeve 59 respectively. In this case, the clutch is always kept at engaged position by the return spring, the clutch is disengaged by operating the clutch lever 31 to the disengaging side against the return spring, and the clutch is automatically returned to the engaged position shown in FIG. 2 by releasing the clutch lever 31.

In FIG. 2, the engine 2 is equipped with a radiator 34 and a coolant reservoir tank 35 etc. at its front upper part, which are housed in an upper half of front end part of the framework 1, and equipped with an exhaust muffler 46 at a rear upper part of the engine 2 as shown in FIG. 1. The exhaust muffler 46 is installed in a lateral position and an exhaust port 46*a* opens toward the right side.

In FIG. 1, the power takeoff shaft is not coaxial with, but deviates to left side from, an axis of the reducing gear input shaft 25 (axis of the engine output shaft 24), and the engine 2 and the reduction gear 3 are installed, as a whole, to the right side in the framework 1.

Other major components composing the drive unit, such as a control board 32, a fuel tank 33 and a battery 45 etc., are housed in and supported by the framework 1.

The control board 32 is installed in the left upper portion of the framework 1, secured to the left-side reinforcing pipe 10 and so-inclined that its indication surface turns slightly to the left upper direction.

The fuel tank 33 is located at a left lower position of the framework 1 and supported by the left side pipe 7 and the cross member 9 through proper brackets. Thus, the fuel tank 33 is installed at a side (left side) opposite to the direction of rotation of the power takeoff shaft R1 (right side) relative to the center of gravity G of the unit.

A battery 45 is installed at a right lower part and supported by the framework 1 through proper brackets.

Dampers 19 supporting four corners of the bottom plate 21 are secured to the cross members 9 of the framework 1 through L-shaped brackets 18 respectively, and plate support surfaces 19*a* at upper ends of the dampers 19 are inclined at an angle of about 45 degrees so that the central portions of the damper (in terms of framework lateral direction) are lower. Inclined bent surfaces 21*a* at four corners of the bottom plate 21 are supported by the inclined plate support surfaces 19*a*.

The rotation direction of the power takeoff shaft 26 is clockwise viewing from the rear side, as indicated by an arrow R1.

A cover 43, which covers the power takeoff shaft 26 on the upper and left and right sides with some clearance put between them, is secured to a rear surface of the reduction gear 3.

As illustrated by FIG. 2, an ignition switch 37, a throttle lever 38, a tachometer 39, an oil pressure indicator lamp 40, a coolant temperature indicator lamp 41 and a charging lamp 42 together with the foregoing clutch lever 31 are installed on the indication surface of the control board 32.

The engine 2 is equipped with a governor (not shown) which senses revolution speed of the engine 2 to throttle its intake mixture within a revolution speed range not exceeding a maximum allowable engine revolution speed so as to control the revolution speed. The single-plate friction clutch 4 has a torque capacity capable of transmission within a range of selected revolution speeds including a maximum power generating revolution speed and a maximum torque generating revolution speed resulting from the control by the governor.

Figure 10:
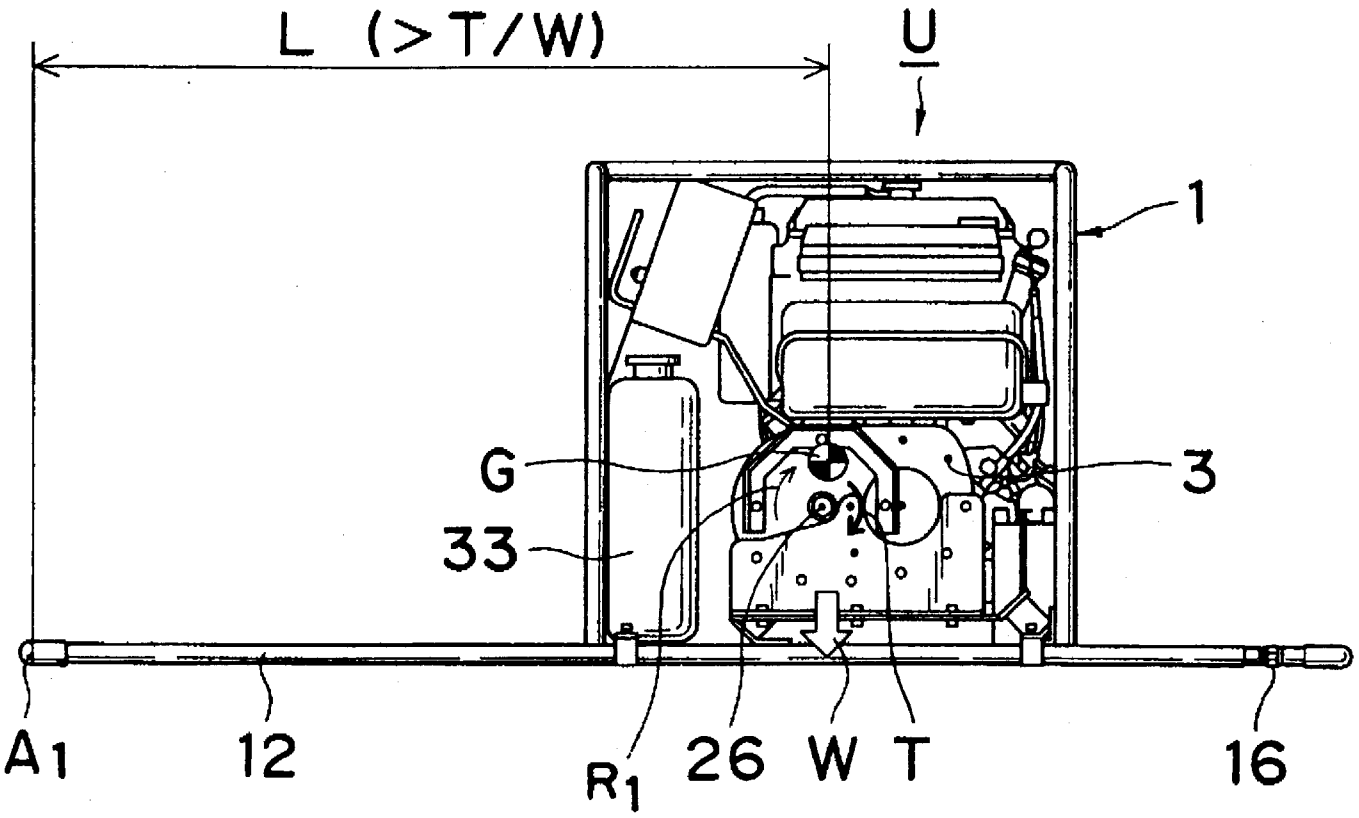

In FIG. 10, a length of the fixing pipe 12 for serving as the fixing means is determined as follows. The length of the fixing pipe 12 is so determined that a distance L from a remotest contact with ground Al to the center of gravity G of the drive unit at a side opposite to a power takeoff shaft revolution direction (R1) i.e. the pipe 12 portion extending to the left side, is set larger than a value obtained by dividing the maximum torque T of the power takeoff shaft 26 by a total weight W of the drive unit U. In other words, the length of the fixing means is so decided as to achieve L>(T/W).

Figure 13:
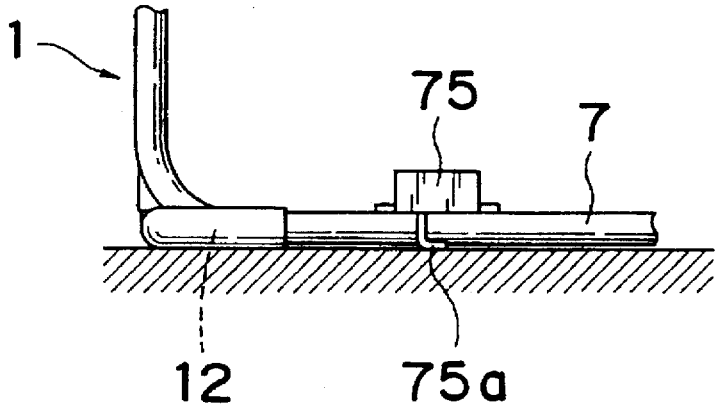
FIG. 13 is an enlarged partial side view of a support and framework equipped with a vibration detection switch.
Figure 14:
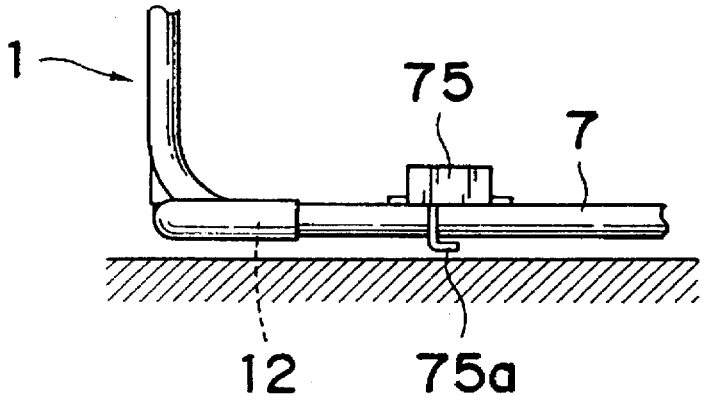
FIG. 14 is a partial view of the support and framework similar to that of FIG. 13 when a large vibration is applied.

A push-type switch 75 may be installed at a bottom part of the framework 1 (side pipe 7) as illustrated by FIG. 13. A push rod 75*a* of the switch 75 is formed into a downward projecting shape, and so adapted that the rod is pushed up by a floor surface to keep an engine key switch of the drive unit at a normally usable condition when the drive unit is place on the floor surface, and the rod 75*a* projects downward to stop operation of the engine when the framework 1 is lifted up by a large vertical vibration as shown by FIG. 14. Thereby, the engine can be stopped automatically even when the drive unit is oscillated to a large extent by the torque reaction.

Figure 16:
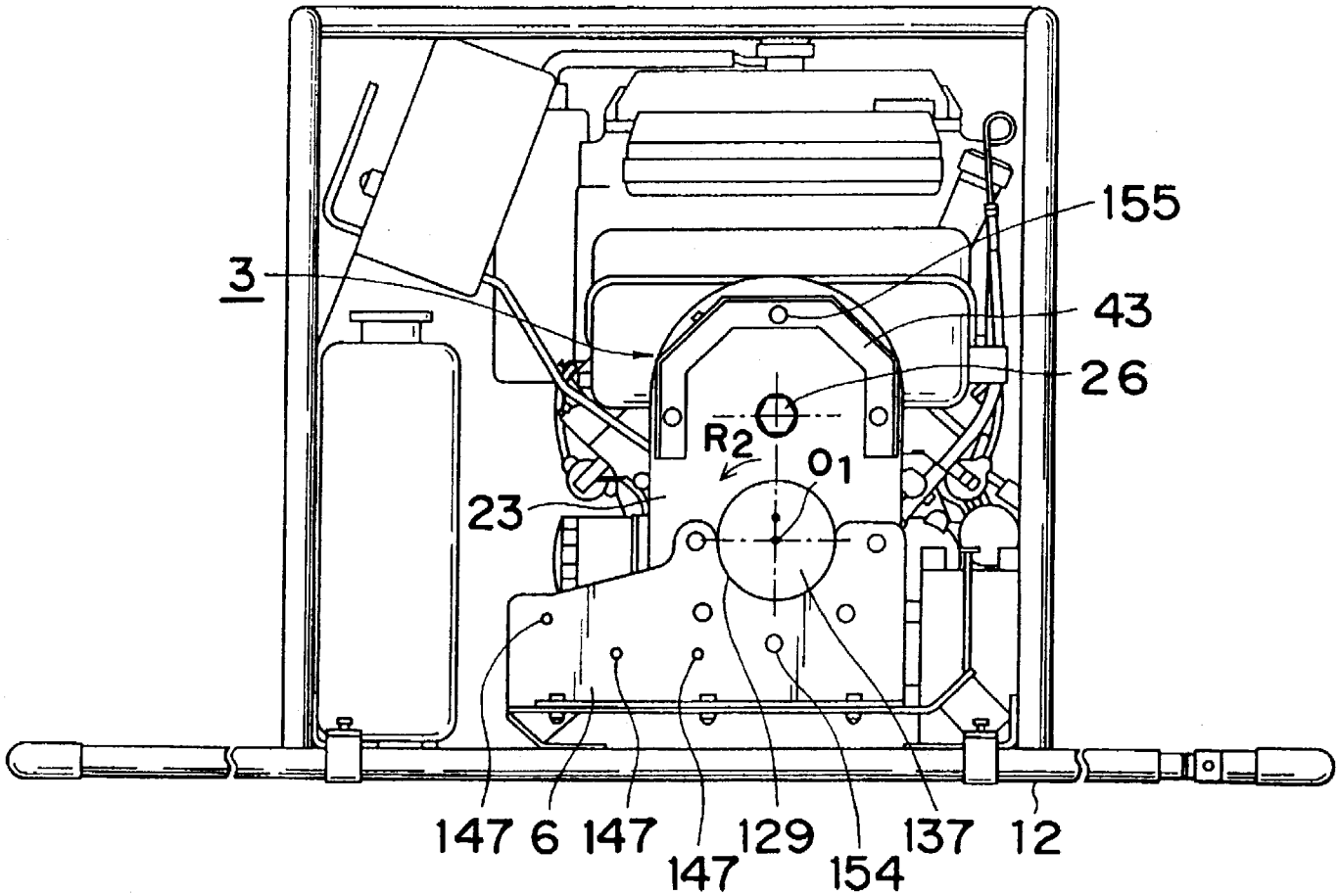
FIG. 16 is a rear view showing the reduction gear in its vertical position.

The reduction gear 3 is so supported as to be changeable in its rotational position by a pair of from and rear support brackets 6 around the axis 01 of the reducing input shaft between a horizontal position, as shown in FIG. 1, and a vertical position, as shown in FIG. 16, according to the invention. The supporting structure will be described hereunder in details.

Figure 15A:
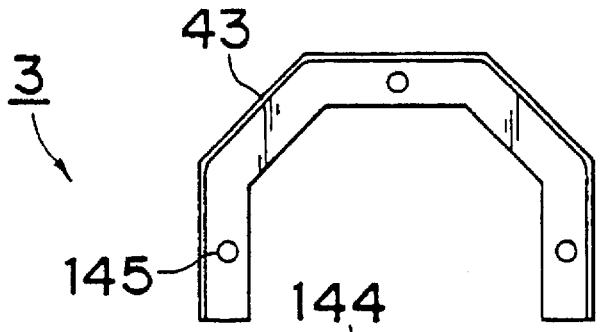
FIG. 15 is a rear view of an exploded view of the reduction gear in lateral position.
Figure 15B:
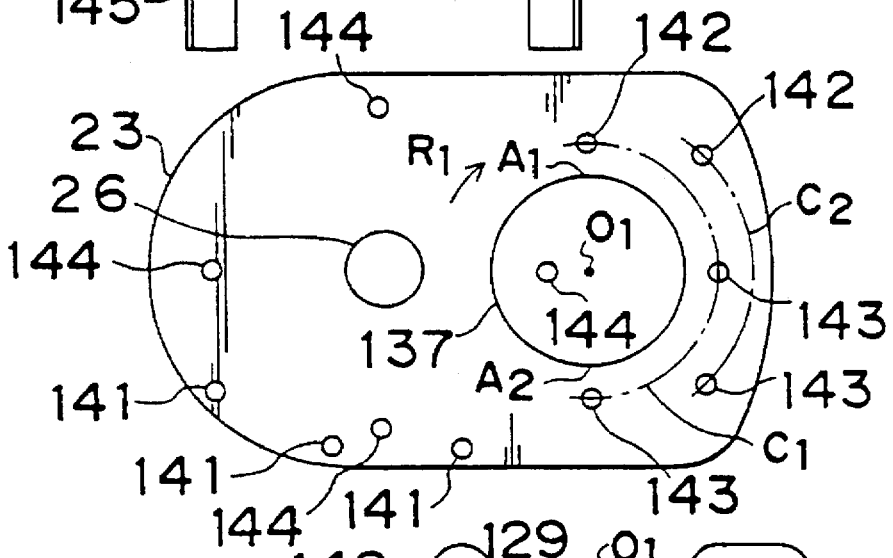
Figure 15C:
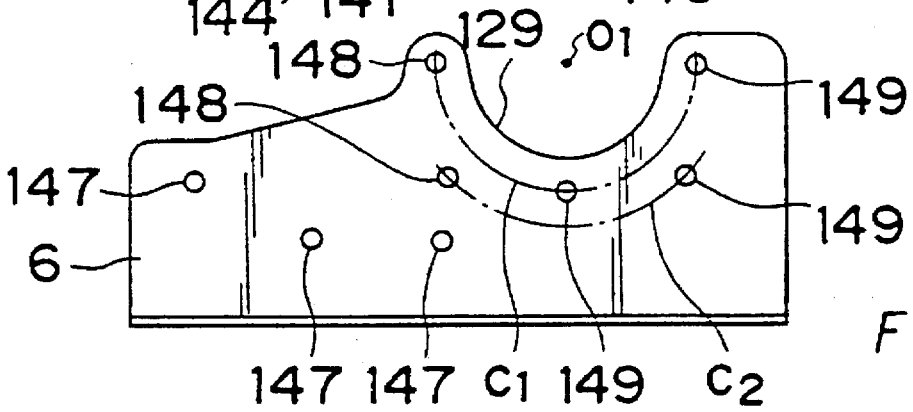

FIG. 15 shows an exploded view of the reduction gear 3 in its horizontal position. Annular aligning stepped surfaces 137 coaxial with the reducing input shaft axis 01 are formed on both front and rear end faces of the reduction gear case 23. Three first female tapped holes 141 for horizontal position only, two second female tapped holes 142 for vertical position only, three third female tapped holes 143 for both positions, and four cover female tapped holes 144 for fitting cover are made thereon. Since locations of respective female tapped holes 141, 142 and 143 are identical in the front and rear end faces of the case, only the locations of holes on the rear end face will be explained.

The first set of female tapped holes 141 are located in a portion of the case 23 at the power takeoff shaft 26 side of the stepped face 137 beneath the cover bottom with some clearance put between them. The second and third sets of female tapped holes 142 and 143 are located about the stepped face 137 from an upper part adjacent an upper portion Al of the annular stepped face 137 to a lower part adjacent a lower portion A2 so as to surround a right half of the stepped face 137 with equal angular clearances of 45° between them. Two positions at full upper and right upper positions are utilized for the second female tapped holes 142.

The full upper, full lower and right female tapped holes 142, 143 and 143 are located on an identical circumference C1, and the right upper and right lower female tapped holes 142 and 143 are located on a circumference C2 having a diameter larger than that of the circumference C1.

The cover female tapped holes 144 are located at full upper, full lower, right and left ends of a circumference concentric with the power takeoff shaft 26.

The support bracket 6 is installed on a plane meeting at a right angle with the engine output shaft axis 01, an upward opening semi-circular concave portion 129 concentric with the engine output shaft axis 01 is formed on an upper part, a diameter of the concave portion 129 is made approximately equal to that of the annular stepped surface 137, and the annular stepped surface 137 fits in the concave portion 129 rotatably. Thereby, the reduction gear case 23 can be rotated around the engine output shaft axis.

Three first bolt holes 147 for horizontal position only, two second bolt holes 148 for vertical position only, and three third female tapped holes 149 for both positions, are made on the bracket 6.

Positions of the first bolt holes 147 correspond to those of the first female tapped holes 141 when the reduction gear case 23 is fitted in the concave portion 129 of the bracket 6 in its horizontal position.

The second and third bolt holes 148 and 149 are so located as to surround the concave portion 129 with equal angular distances of 45° put between them, and two holes at left upper and left lower positions are utilized for the second bolt holes 148. Among these second and third bolt holes 148 and 149, respective bolts holes 148, 149 and 149 at left upper, right upper and central lower positions are located on a circumference C1 of the reduction gear case 23, and respective bolts holes 148 and 149 at left lower and right lower positions are located on a circumference having the same diameter with that of the circumference C2 of the reduction gear case 23.

Figures 17A, 17B, 17C:
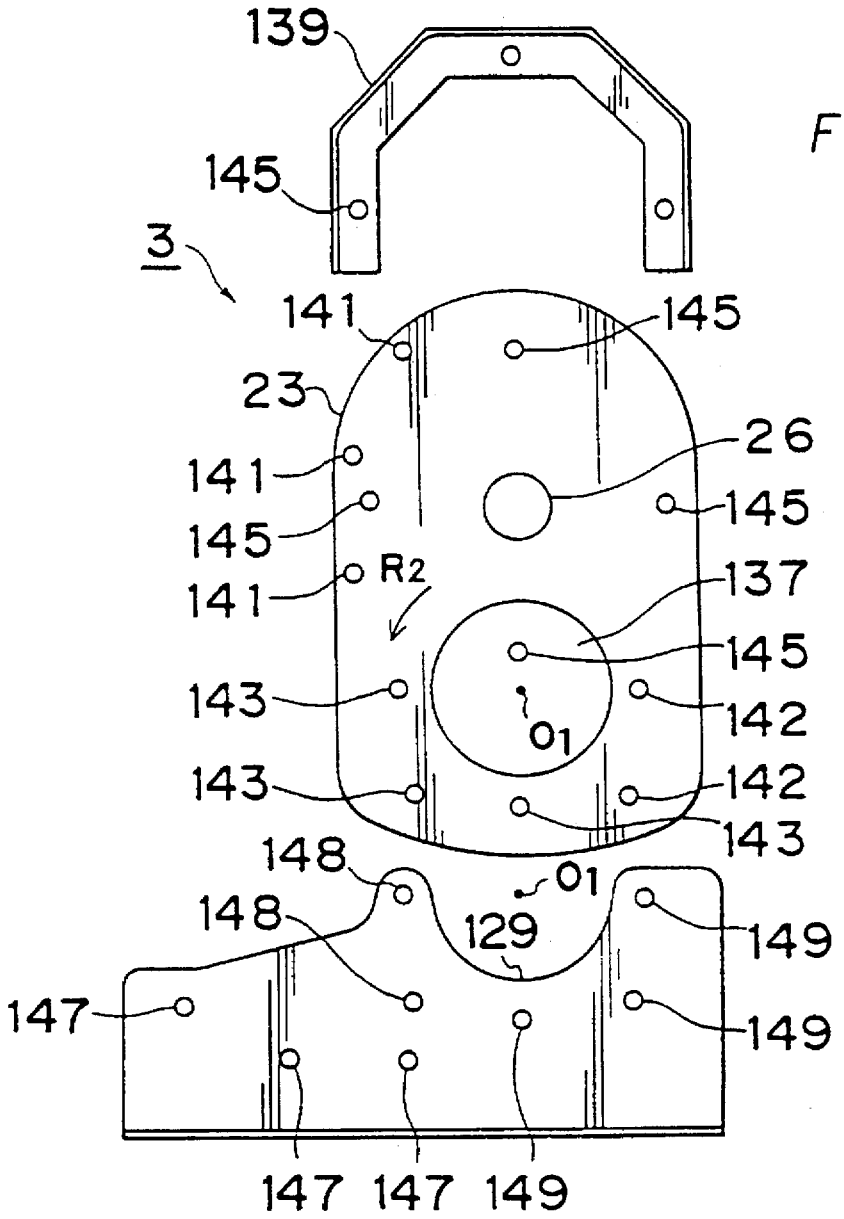
FIG. 17 is an exploded rear view of the reduction gear in its vertical position.

When the annular stepped surface 137 of the reduction gear case 23 is fitted in the concave portion 129 in its horizontal position, respective first female tapped holes 141 of the reduction gear case 23 align with respective first bolt holes 147 and respective third female tapped holes 143 align with respective third bolt holes 149. The reduction gear case 23 is secured to the bracket 6 in its horizontal position by passing the bolts through these bolt holes 147 and 149 and screwing them in the female tapped holes 141 and 143. On the other hand, when the reduction gear case 23 is turned by 90° in a direction of arrow R1 in FIG. 15 from the horizontal position around the reducing input shaft 01 to a vertical position, as shown in FIG. 17, the second and third female tapped holes 142 and 143 align with the third and second bolt holes 149 and 148. The reduction gear case 23 is secured to the bracket 6 in its vertical position by passing the bolts through these bolt holes 149 and 147 and screwing them in the female tapped holes 142 and 143.

Function will be explained hereunder.

One end of a coupling shaft 50 having a universal joint, as shown by imaginary lines, is spline coupled to the power takeoff shaft 26 of FIG. 2, and the other end of the coupling shaft 50 is spline coupled to a work machine (not shown).

The clutch lever 31 of FIG. 2 is turned to a direction shown by an arrow L to keep the clutch 4 at the disengaged position, then the ignition switch 37 is operated to start the engine 2.

When a specified engine revolution speed is attained, the clutch lever 31 is slowly returned to engage the clutch 4.

Thereby, the power takeoff shaft 26 of the reduction gear 3 is rotated through the clutch 4 at a specified revolution speed (540 RPM, for example) and the work machine is thus operated.

When a single-plate friction clutch is used for the clutch 4, an over-load can be avoided without stopping the engine in a case in which the unit is coupled to a device, such as a grain elevator or a hole digger (auger-type digger), which is subjected to a temporary over-loaded torque because these machines deal with powdery or solid articles.

Accordingly, when a large load is applied to the power takeoff shaft, the single-plate friction clutch can be controlled to slip to bring about a partial-engaging state, a high torque is thereby maintained at a low revolution, and the over-loaded state can be avoided.

In order to move the drive unit, it can be carried to a neighboring place by grasping the both front and rear ends of the fixing pipe 12 of FIG. 2 with hands on the grips or it can be transported to a remote place by using a truck, etc.

Figure 12:
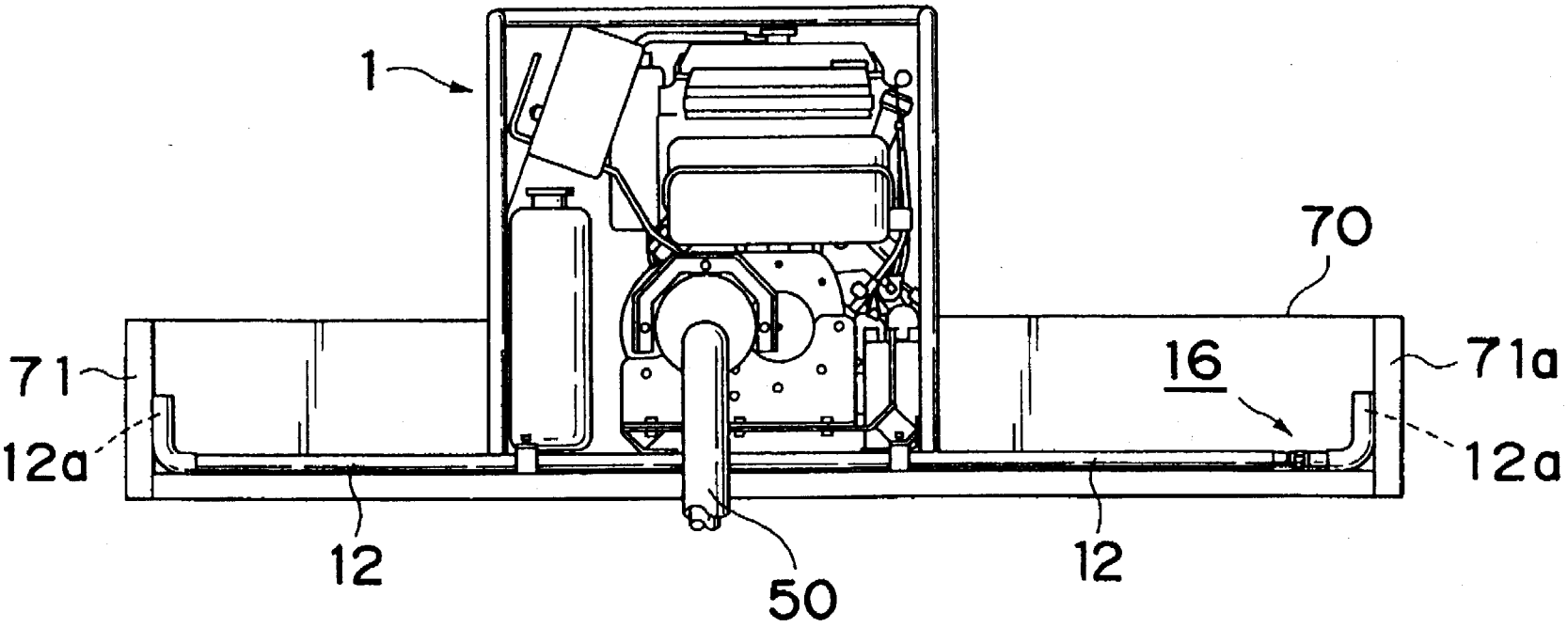
FIG. 12 is an enlarged view viewed in a direction of the arrow XII in FIG. 11.

When the unit is transported on a vehicle, the fixing pipes 12 are expanded to press the bent portions 12*a* on both the left and right ends of the pipes against both left and right side plates 71 of a vehicle body 70, as shown by FIG. 12, so as to fix the unit. Namely, the unit is thrust to, and fixed between, the both side plates 71.

Figure 11:
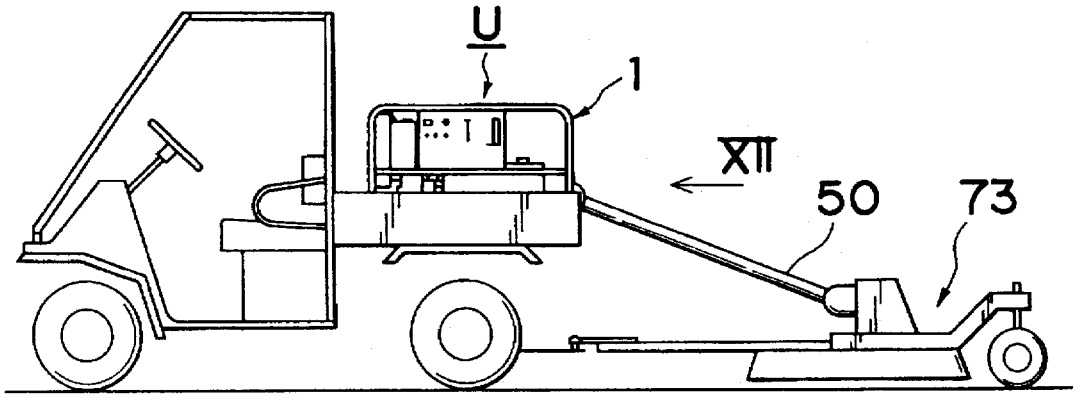
FIG. 11 is a side view showing a state where the drive unit according to the invention is operated by being mounted on and fixed to a track.

When the unit is mounted on a vehicle and work is to be carried out, the power takeoff shaft of the drive unit U is directly coupled to an input shaft of a drive unit 73 of lawn mower, etc. by a coupling shaft 50 having a universal joint so as to operate the driven unit 73, as illustrated by FIG. 11.

The input shaft of the driven unit 73 is driven at a specified revolution speed reduced by a reduction gear, at 540 RPM.

When the unit is placed and operated at a location, such as a floor surface or a ground surface having no fixing means, and the left projection length of the fixing pipe 12 is set, as shown by FIG. 10, the unit is placed on the floor surface as it is, and the reducing output shaft 26 is coupled through a coupling shaft to an input shaft of a stationary agricultural work machine, such as a grain elevator etc. The distance L from the remotest contact with ground Al to the center of gravity G of the unit is set larger than a value obtained by dividing the maximum torque T of the power takeoff shaft 26 by the unit weight W, so that a momentum force around the contact with ground Al caused by the weight of unit can be larger than a momentum force caused by the torque reaction and a vertical oscillation due to the torque reaction can be prevented during the work.

As illustrated in FIG. 1, the fuel tank 33 is installed at a side opposite to the power takeoff shaft revolution direction side relative to the center of gravity G of the unit, so that a momentum force caused by the fuel weight against the torque reaction is not changed considerably due to a decrease in fuel when the unit is operated continuously. In case, for example, when unmanned operation is carried out after commencing the operation with a full fuel tank, the momentum force caused by the fuel weight against the torque reaction decreases with a decrease in fuel. However, since the fuel tank 33 is located at a momentum fulcrum point (Al) side, an influence due to the decrease in fuel is small and a change in momentum forces against the torque reaction become small between immediately after commencing the operation and after an elapse of a period of continuous operation.

If the drive unit is oscillated considerably during the operation, the engine is stopped because the contact switch 75 turns the engine off, as shown by FIG. 14.

Figure 18:
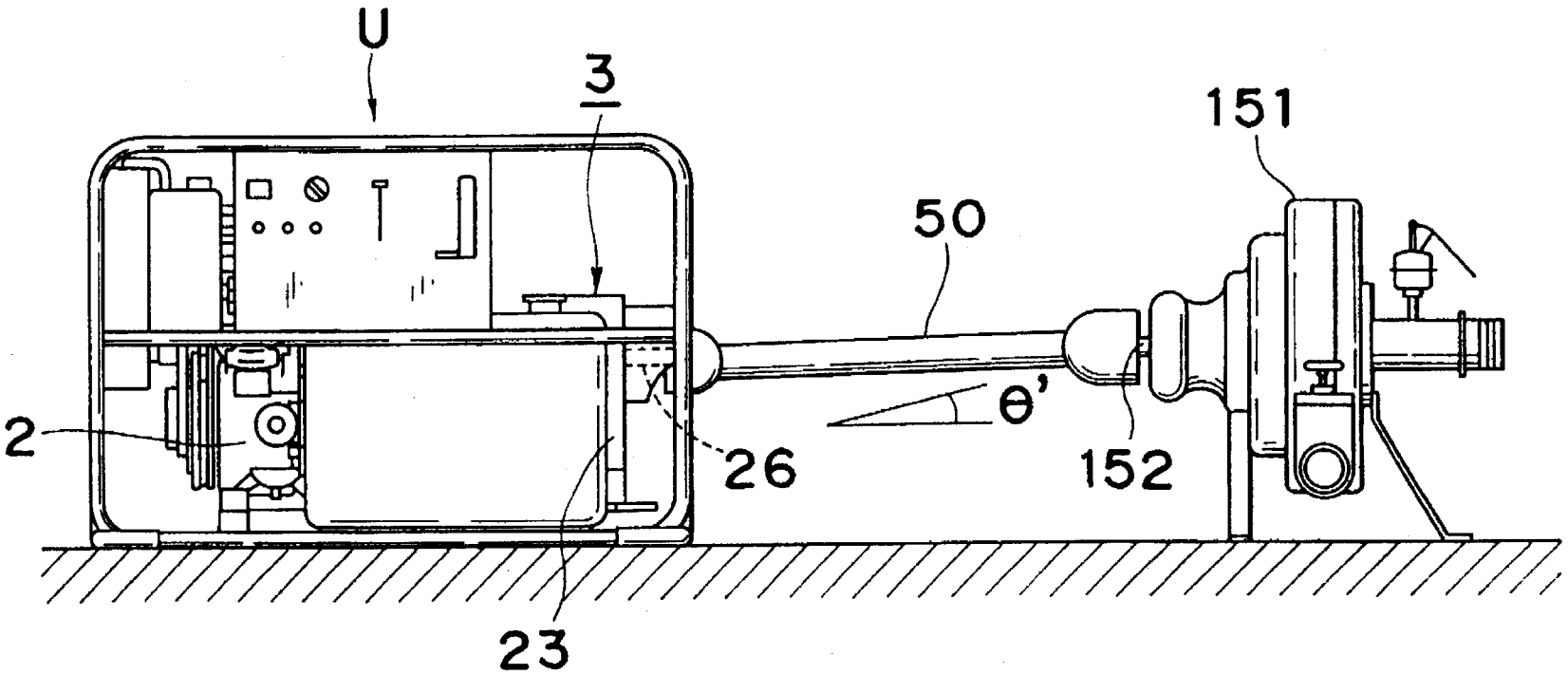
FIG. 18 is a side view showing a state in which the drive unit according to the invention is installed on a floor surface.

When the drive unit U and a driven unit 151, such as a pump etc., are installed on a ground surface and an input shaft 152 of the driven unit 151 stands higher, as illustrated in FIG. 18, the reduction gear 3 can be fastened in its vertical position, as shown by FIG. 16, so as to heighten the position of the power takeoff shaft 26.

Figure 19:
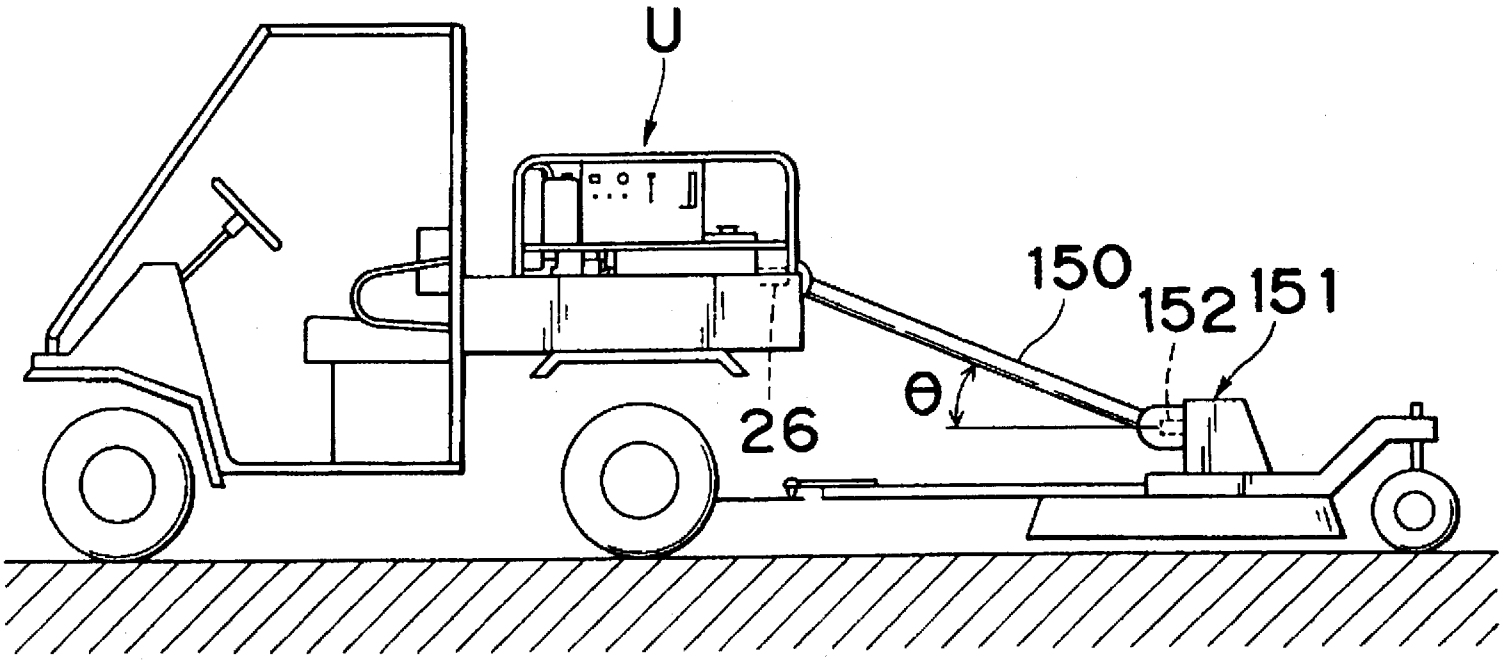
FIG. 19 is a side view showing a state in which the drive unit is operated by being mounted on, and fixed to, a vehicle.

In the case in which the drive unit U is mounted on a vehicle and the driven unit 151 lower than the unit is trailed by the vehicle, as shown in FIG. 19, the reduction gear can be fastened in its horizontal position, as shown by FIG. 1, to lower the position of the power takeoff shaft 26.

In order to change the rotational position of the reduction gear 3, the case fitting bolts 154 and the cover fitting bolts 155 are removed to take out the cover 43, and the reduction gear case 23 is turned from its vertical position of FIG. 16 to its horizontal position in a direction of arrow R2 while the front and rear annular stepped surfaces 137 are supported by the both front and rear concave portions 129. In this horizontal position, the reduction gear case 23 is fastened by the bolts 154 and 155, and the cover 43 is also fastened. Since the cover 43 will be inside the annular stepped surfaces 137 in this horizontal position, it is recommended to use a shim, or the like, having a height corresponding to that of its section at an outer part of the stepped surface 137 in order to eliminate a stepped difference created at a stepped difference cover fitting surface.

Owing to these measures, a tilting angle of the axle shaft 50 relative to a horizontal plane can be mimimized, a power transmission loss can be reduced, and a weight of the unit can be lessened by shortening the length of the axle shaft, as represented by FIG. 18 and FIG. 19.

In each example of work shown in FIG. 18 and FIG. 19, the input shaft 152 of the drive unit 151 is driven at a specified revolution speed reduced by the reducing gear 3, at 540 RPM for example.

(Embodiment 2)

Figure 6:
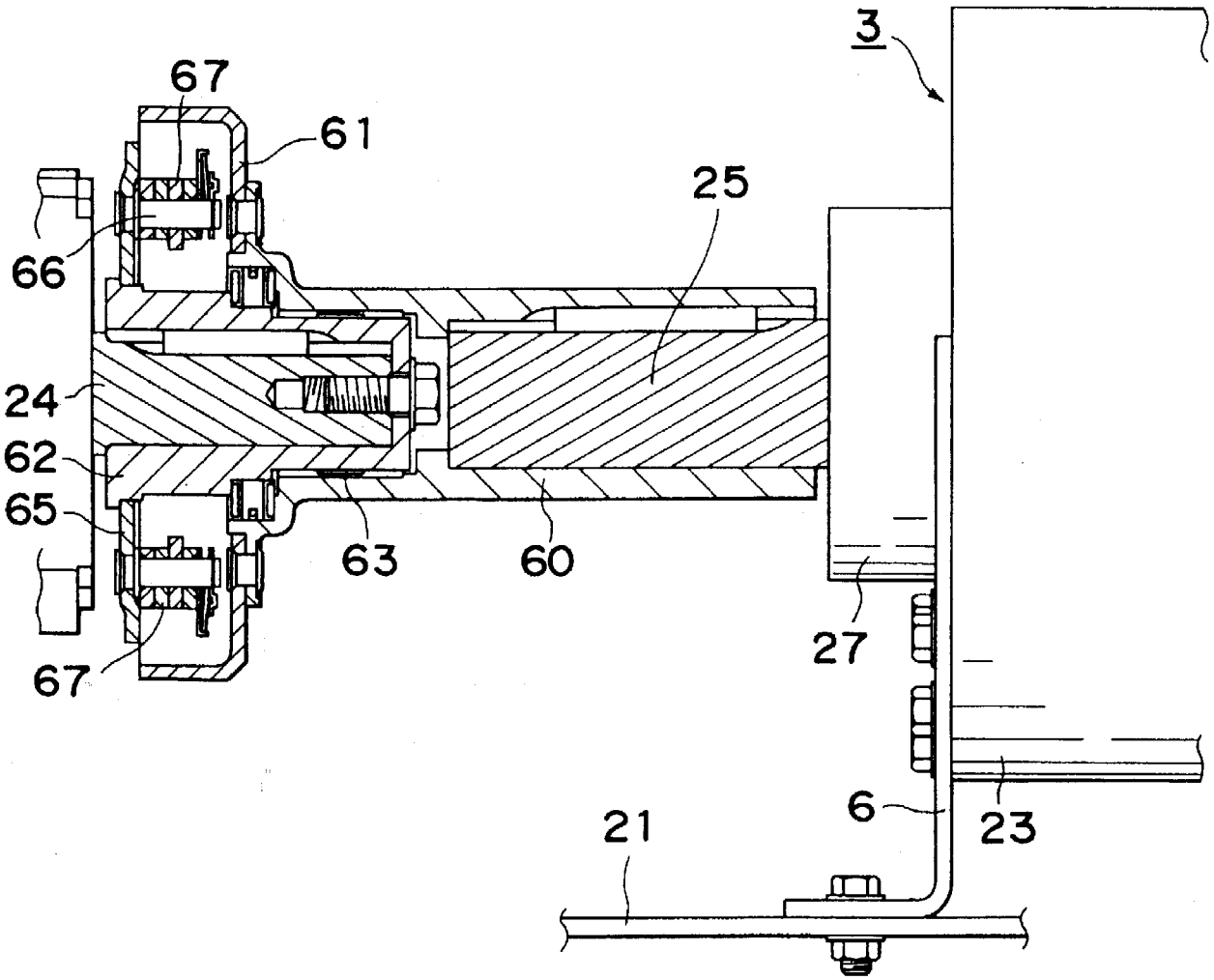
FIG. 6 is a vertical sectional side view of a centrifugal friction clutch applied to the invention.

In correspondence with the embodiment of the invention as shown in FIG. 6, a centrifugal friction clutch may be installed. A driven-side hub 60 is coupled to the reducing input shaft 25, and a cover and clutch drum 61 is secured to the driven-side hub 60 while the clutch fits onto the engine output shaft 24 through a bush 63 installed on an inner peripheral surface of the driven-side hub 60, and a drive-side hub 62 integrally having a shoe support plate 65 is coupled to the output shaft 24. Support pins 66 are provided on plural circumferential places of the shoe support plate 65 and a clutch shoe 67, which is urged by spring radially inwardly and extended outwardly by centrifugal force to press on a drum inner peripheral surface, is supported rotatable to the support pin 66.

When the centrifugal friction clutch is installed, the clutch is automatically disengaged at time of starting the engine and the clutch is engaged by a centrifugal force while the engine revolution increases up to a specified value.

In the event when an over-load is applied from the work machine, the over-loaded state can be avoided by the slippage of clutch in the same way as the single-plate friction clutch.

(Embodiment 3)

Figure 20:
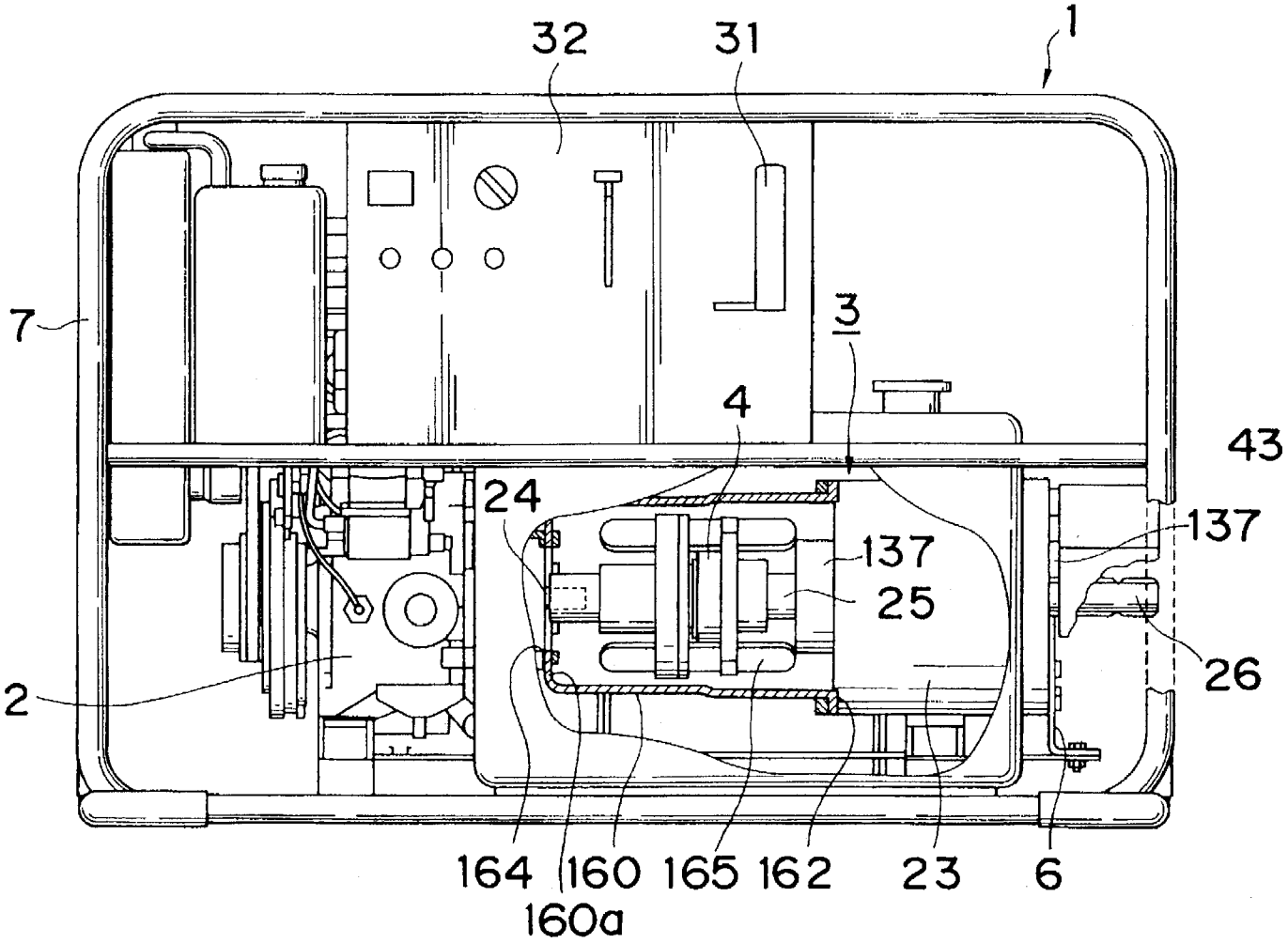
FIG. 20 is a side view showing the portable drive unit of the invention in which the reduction gear is in a horizontal position.

FIG. 20 shows another embodiment of the drive unit of the invention. In order to improve the concentricity between the output shaft 24 of the engine 2 and the input shaft 25 of the reduction gear 3, a rigid cylindrical positioning guide cover 160 made of metal, which covers outer peripheral of the clutch 4 coaxial with the engine output shaft 24 and connects the engine output shaft side with the reducing input shaft side, is installed between them. As compared with the embodiment of FIG. 2, the front side bracket 6 is eliminated among the front and rear brackets 6 and the engine is supported through the guide cover 160 instead.

An annular recess 162 concentric with the reducing input shaft 25 is formed on a front end face of the reduction gear case 23. The rear edge of the cylindrical guide cover 160 is fitted in the annular recess 162 and secured thereto by bolts, or the like.

The guide cover 160 extends forward so as to cover the clutch 4. On the other hand, an annular stepped surface 164 concentric with the engine output shaft axis is formed on a crank case rear end face of the engine 2 and a rear inward flange 160*a* of the guide cover 160 fits in the annular stepped surface 164 so that the cover is fastened by bolts to a crank case.

Thereby, the concentricity between the engine 2 and the reduction gear 3 can be secured more easily. An air hole 165 for ventilating the inside of the cover 160 is made in an intermediate portion of the wall of the cover 160.

(Other Embodiments)

(1) The engine mounted on the unit may be of single-cylinder type, or three-or more cylinder type, and may be a two-cycle engine.

(2) The reduction gear 3 is inexpensive when it is of the fixed speed change stage type (single stage type) utilizing a pair of large and small gears as described in the foregoing embodiment. However, a reduction gear of plural speed change stage type may be used.

(3) Usually, the structure reducing the revolutions down to 540 RPM will be sufficient in an agricultural machine. However, when the unit is used with other small lawn maintenance machines, such as a work machine operated at 1000 RPM for example, it is necessary to equip a reduction gear which reduces the revolutions down to the above value.

I claim:

1. A portable drive unit including an engine, a reduction gear driven by said engine and an output shaft operatively connected to said reduction gear to form a power takeoff shaft of said drive unit, and means for supporting said drive unit comprising:

a plurality of straight pipe members disposed as a substantially rectangular prism having longitudually spaced upstanding sides forming a framework supporting said drive unit, a pair of mutually-spaced straight pipe members forming fixing means disposed at substantially right angles to said power takeoff shaft, said fixing means being disposed at the bottom of said framework extending beyond the respective sides thereof and providing vertical support for said framework and said drive unit, said pipe members forming said fixing means each having an end defining a point of contact with ground and a length longer than a width of said framework, wherein the length of said fixing means is determined as a distance measured from the center of gravity of the unit to a point of contact of said fixing means with ground on the opposite side of the center of said power takeoff shaft from such point at which the peripheral velocity thereof is directed downward set larger than the value obtained by dividing the maximum torque of the power takeoff shaft by the total weight of the unit.

2. A portable drive unit as set forth in claim 1 in which said pipe members forming said fixing means are fixed at bottom portions of said framework at opposite ends thereof.

3. A portable drive unit as set forth in claim 1 including means for expanding the length of said pipe members forming said fixing means.

4. A portable drive unit as set forth in claim 1 including a fuel tank disposed in said framework at a location on the opposite side of the center of said power takeoff shaft from such point at which the peripheral velocity thereof is directed downward.

5. A portable drive unit comprising:

a framework having a bottom for supporting said drive unit;

an engine supported on said framework bottom;

a reduction gear having an input shaft drivingly connected to said engine, an output shaft forming a power take-off shaft for said drive unit eccentrically disposed with respect to said input shaft and an enclosing case; and means for mounting said reduction gear to said framework bottom for adjustable positioning of said power take-off shaft with respect thereto, said mounting means including:

a substantially cylindrical stepped face on said reduction gear case in concentric alignment with said input shaft;

a bracket fixedly secured to said framework bottom and having a concave portion of semi-circular form to receive said stepped face on said reduction gear case for angular adjustment thereon, and cooperative sets of mutually spaced bolt holes in said bracket and said case, respectively, and operative to secure said reduction gear case with respect to said bracket in various angularly displaced positions.

6. A portable drive unit as set forth in claim 5 in which said engine includes an output shaft and including a clutch coaxially disposed with respect to said engine output shaft installed between said engine and said reduction gear, and a cylindrical positioning guide cover covering said clutch about the outer periphery thereof, said guide cover being disposed between, and interconnecting, said engine and said reduction gear.

* * * * *